United States Patent [19]

Griffin

[11] 4,201,065

[45] May 6, 1980

[54] VARIABLE CAPACITY VAPOR COMPRESSION REFRIGERATION SYSTEM

[75] Inventor: Charles K. Griffin, Auburn, N.Y.

[73] Assignee: Carrier Corporation, Syracuse, N.Y.

[21] Appl. No.: 970,516

[22] Filed: Dec. 18, 1978

[51] Int. Cl.[2] ..... F25B 1/10

[52] U.S. Cl. ..... 62/510; 62/196 C; 62/504; 62/524

[58] Field of Search ..... 62/196 C, 510, 504, 62/524, 525

[56] References Cited

U.S. PATENT DOCUMENTS

| | | | |
|---|---|---|---|
| 3,866,439 | 2/1975 | Bussjager et al. | 62/504 |
| 4,040,268 | 8/1977 | Howard | 62/510 |
| 4,157,649 | 6/1979 | Bussjager et al. | 62/510 |

*Primary Examiner*—Ronald C. Capossela

*Attorney, Agent, or Firm*—J. Raymond Curtin; John S. Sensny

[57] ABSTRACT

A vapor compression refrigeration system comprising a condenser including a plurality of generally parallel heat exchange fins and a plurality of refrigerant circuits running through the condenser generally transverse to the heat exchange fin, wherein groups of the refrigerant circuits cover in overlapping fashion the area of the condenser transverse to the direction of the flow of an external heat exchange medium moving thereover. The system also comprises one or more compressors; a plurality of high pressure refrigerant lines for passing refrigerant from the compressor or compressors to the condenser; a refrigerant distribution device in each of the high pressure lines, wherein each group of condenser refrigerant circuits is connected to a different distribution device; and means for selectively preventing the flow of refrigerant through at least a selected one of the high pressure refrigerant lines, wherein the group of circuits connected to the distribution device in the selected refrigerant line is removable from service without appreciably reducing the effective heat exchange area of the condenser.

5 Claims, 2 Drawing Figures

VARIABLE CAPACITY VAPOR COMPRESSION REFRIGERATION SYSTEM

BACKGROUND OF THE INVENTION

Figure 1:
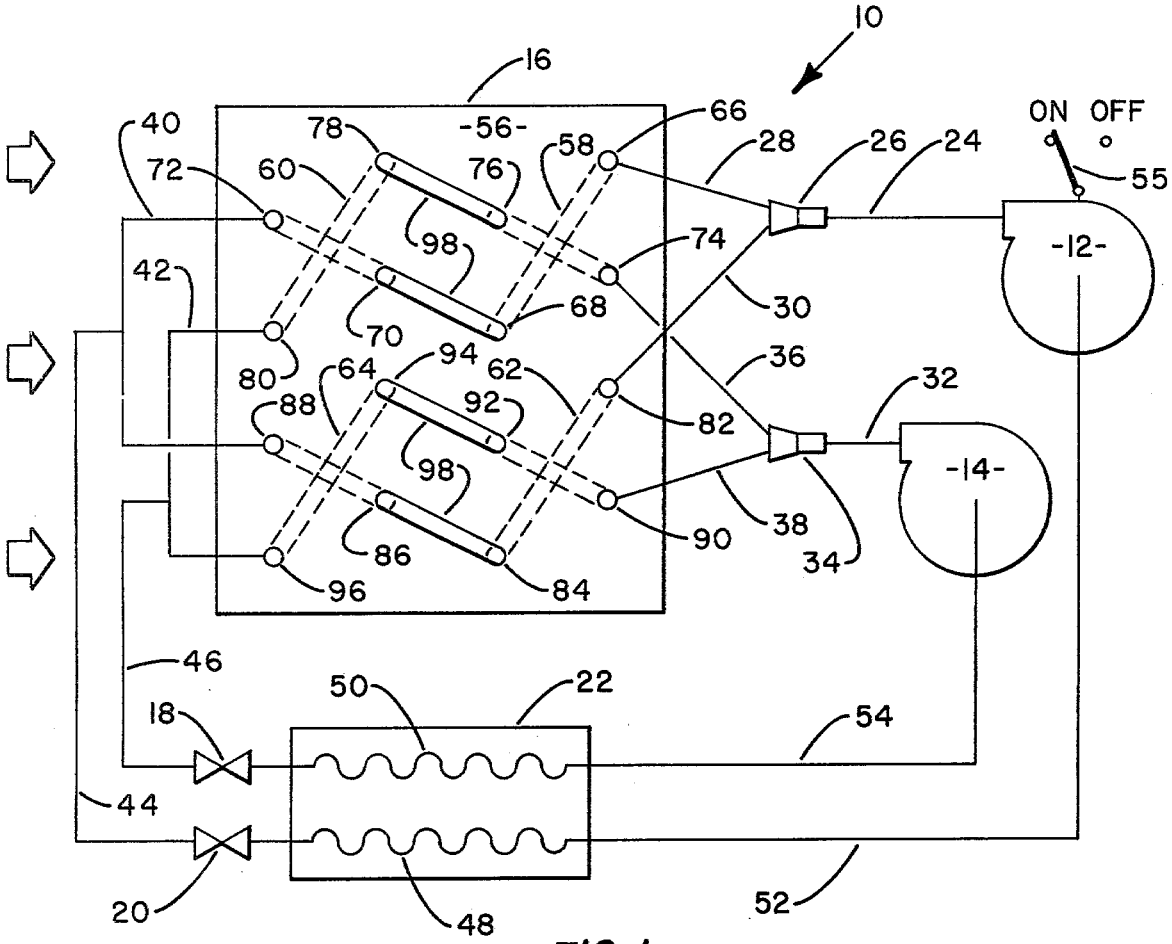

The present invention relates generally to vapor compression refrigeration systems, and more particularly to a vapor compression refrigeration system having a variable capacity, multi-circuit refrigerant condenser.

Compression refrigeration systems generally comprise a compressor, a condenser, an expansion device, and an evaporator connected by appropriate refrigerant lines to form a refrigeration circuit. Refrigerant vapor is compressed by the compressor and fed to the condenser where the refrigerant releases heat to a cooling medium and condenses. The condensed refrigerant then flows through the expansion device where the pressure of the refrigerant is reduced. From the expansion device, the refrigerant passes into the evaporator, absorbs ambient heat, and vaporizes. Vaporous refrigerant is then drawn back into the compressor, completing the circuit.

Refrigeration systems of the foregoing type are frequently used in situations such as commercial and industrial buildings where the load upon the system may vary. It is common to design the system to meet the maximum load to which it may be subjected, and to reduce system capacity under low load conditions. Frequently, such a system may have a plurality of compressors wherein system capacity is reduced by removing one or more compressors from operation, or the system may have a variable capacity compressor wherein system capacity is reduced by reducing compressor capacity, for example by partially or completely unloading some of the piston cylinders of the compressor if the compressor is of the reciprocating piston type.

Variable capacity refrigeration systems generally include a condenser having a plurality of refrigerant circuits, and a plurality of high pressure fluid lines for conveying refrigerant from the compressor or compressors of the system to the condenser circuits thereof. Each condenser circuit includes a set of parallel tubes which commonly extend through a plurality of generally parallel, planar heat transfer fins. The tubes are generally perpendicular to the planes of the fins, with tubes at each end of the condenser being connected by return bends to form the circuit. These circuits are divided into a number of groups. Each group is supplied with refrigerant from a different one of the high pressure lines connecting the condenser with the compressor, usually via a refrigerant distribution device located in the line. One or more of the high pressure refrigerant lines may each include a valve which can be closed to prevent refrigerant from passing through the line. When refrigerant is prevented from passing through a high pressure refrigerant line, refrigerant is also prevented from passing through the condenser circuits which are fed by that line. Alternately, each line can be supplied with refrigerant by a separate compressor, in which case refrigerant can be prevented from passing through selected condenser circuits by shutting down the compressor supplying the line which feeds the circuits.

Under low load conditions, the capacity of the refrigeration system is reduced, and refrigerant flow through one or more high pressure refrigerant lines is prevented so that the refrigerant circuits fed by the closed line or lines are removed from operation. By removing selected groups of condenser circuits from operation in response to reduction in compressor capacity, a relatively high vapor pressure can be more easily maintained in those circuits which remain in operation. This improves condenser performance. For example, preserving a high vapor pressure facilitates maintaining stable vapor flow through the heat exchange tubes of the condenser. Further, since vapor temperature generally increases with pressure, maintaining a high vapor pressure preserves a high vapor temperature; and this maintains a larger temperature difference between the refrigerant vapor and the cooling medium, improving heat transfer therebetween. With prior art variable capacity condensers, however, a concomitant result of removing selected groups of condenser refrigerant circuits from operation has been to reduce the effective heat exchange area of the condenser. This detrimentally affects condenser performance.

SUMMARY OF THE INVENTION

An object of the present invention is to improve variable capacity refrigeration systems, particularly the condensers thereof.

Another object of this invention is to provide a variable capacity refrigerant condenser having a plurality of refrigerant circuits wherein selected groups of circuits can be removed from operation without appreciably reducing the effective heat exchange area of the condenser.

Still another object of the present invention is to intertwine the refrigerant circuits of a multi-circuit refrigerant condenser.

A further object of the present invention is to locate the refrigerant discharge tubes of a variable capacity condenser at the side thereof at which an external heat exchange medium enters the condenser.

These and other objectives are attained with a vapor compression refrigeration system comprising evaporator means, compressor means, and expansion means. The system further comprises a condenser including a plurality of heat exchange fins and a plurality of refrigerant circuits running through the condenser, wherein groups of the refrigerant circuits cover in overlapping fashion the area of the condenser transverse to the direction of the flow of an external heat exchange medium moving thereover. The vapor compression refrigeration system also comprises a plurality of high pressure refrigerant lines for passing refrigerant from the compressor means to the condenser; refrigerant distribution means in each of the high pressure refrigerant lines, wherein each group of refrigerant circuits is connected to a different distribution means; and means for selectively preventing the flow of refrigerant through at least a selected one of the high pressure refrigerant lines, wherein the group of circuits connected to the distribution means in the selected refrigerant line is removable from service without appreciably reducing the effective heat exchange area of the condenser.

A BRIEF DESCRIPTION OF THE DRAWINGS

Figure 2:
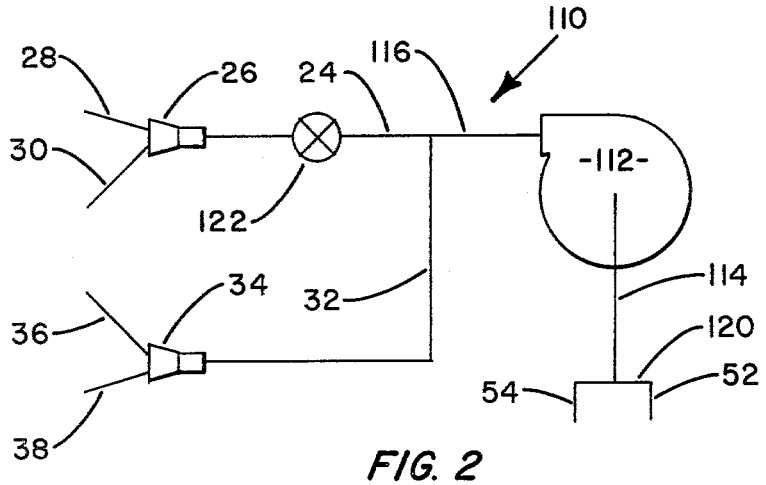

FIG. 1 shows in schematic form a vapor compression refrigeration system utilizing the teachings of the present invention; and FIG. 2 shows in schematic form a portion of an alternate vapor compressor refrigeration system also utilizing the teachings of the present invention.

A DETAILED DESCRIPTION OF THE PREFERRED EMBODIMENT

The description to follow relates to a condenser having a plurality of refrigerant circuits running therethrough and to refrigeration systems incorporating such a condenser. For the sake of this description, the condenser is presumed to have a conventional finned-tube construction in that it comprises a large number of generally parallel, planar, heat exchange fins through which tubes or other refrigerant conduits extend transverse to the planes of the fins. An end view of the condenser is shown in FIG. 1. Thus, the portions of the tubes which are visible in FIG. 1 are the ends thereof and the curved connecting tubes or return bends which connect the various parallel tubes together to form the refrigerant circuits. The "depth" of the condenser, as this term is used herein, refers to the right to left dimension of the condenser as viewed in the drawing. The "height" of the condenser is the top to bottom dimension of the condenser as shown in the drawing. Similarly, the "length" of the condenser refers to that dimension extending into the plane of the drawing.

Referring to FIG. 1 in more detail, a vapor compression refrigeration system is shown and referenced generally as 10. System 10 includes compressors 12 and 14, condenser 16, expansion means 18 and 20, and evaporator 22. Refrigerant line 24 leads from compressor 12 and terminates in refrigerant distributor 26. A plurality of parallel refrigerant lines 28 and 30 lead from distributor 26 to a first group of refrigerant circuits running through condenser 16, discussed in greater detail below. Similarly, refrigerant line 32 leads from compressor 14 and terminates in refrigerant distributor 34, and a plurality of parallel refrigerant lines 36 and 38 lead from distributor 34 to a second group of refrigerant circuits running through condenser 16. The various refrigerant circuits of condenser 16 terminate in refrigerant headers 40 and 42, which are in turn connected to refrigerant lines 44 and 46. Refrigerant passes through lines 44 and 46, through expansion devices 18 and 20, and into evaporator 22. Refrigerant circuits 48 and 50 are located in evaporator 22, and these circuits are connected to inlets or suction lines 52 and 54 of, respectively, compressors 12 and 14.

With the exception of condenser 16, the elements of system 10 can be of any known type and can function in a normally expected manner. Accordingly, compressors 12 and 14 discharge hot compressed refrigerant vapor into lines 24 and 32, and the refrigerant proceeds to distributors 26 and 34. These distributors can be, for example, fabricated from solid materials and have a plurality of refrigerant passages defined therein for distributing the refrigerant to parallel refrigerant lines 28, 30, 36 and 38, which lead to the refrigerant circuits of condenser 16. Refrigerant passes through the circuits of condenser 16, and the refrigerant gives up heat to an external heat exchange medium such as air whose direction of movement over the condenser is parallel to the plane of heat exchange fins 56 as indicated by the arrows in the drawing. The external heat exchange medium first crosses condenser 16 at the side thereof at which refrigerant is discharged therefrom. This increases the temperature difference between the refrigerant and the external heat exchange medium, improving heat transfer therebetween.

As refrigerant passes through condenser 16, the refrigerant condenses and liquid refrigerant proceeds through headers 40 and 42, through lines 44 and 46, and through expansion means 18 and 20. Expansion means 18 and 20 function to reduce the pressure of refrigerant passing therethrough and can be of any appropriate type such as thermal expansion valves or capillary tubes. The expanded refrigerant proceeds through circuits 48 and 50 of evaporator 22, and heat is transferred to the refrigerant from an external heat exchange medium such as air moving thereover. The refrigerant vaporizes as it passes through evaporator 22. Refrigerant vapor is discharged from evaporator 22 into refrigerant vapor inlet lines 52 and 54 leading back to, respectively, compressors 12 and 14.

As described above, system 10 includes two compressors 12 and 14, with a closed refrigeration loop including a group of condenser circuits associated with each compressor. System capacity is reduced by shutting down one of the compressors 12 or 14, thereby preventing fluid flow through one of the two refrigerant loops and the associated condenser circuits. Means for deenergizing compressor 12 are represented in FIG. 1 by switch 55, and the compressor is shut down by moving the switch from the "on" position to the "off" position. Alternately, with modifications well within the purview of one skilled in the art, the teachings of the present invention could be utilized in a vapor compression refrigeration system employing a single compressor. Portions of such a system, referenced as 110, are shown in FIG. 2, it being understood that, except for compressor 112, refrigerant lines 114 and 116, header 120 and valve 122, the remaining elements of system 110 are identical to those of system 10 shown in FIG. 1, and like numbers are used to refer to common elements shown in both Figures. With system 110, refrigerant lines 52 and 54 terminate in header 120, which leads to inlet line 114 of compressor 112. Compressor 112 discharges compressed refrigerant vapor into line 116, which terminates in parallel refrigerant lines 24 and 32 leading to, respectively, distribution devices 26 and 34. With this alternate arrangement, system capacity is reduced by reducing the capacity of compressor 112, and flow through one of the groups of condenser circuits is prevented by closing valve 122 located in refrigerant line 24.

Condenser 16 includes a plurality of heat transfer fins 56 and a plurality of refrigerant circuits 58, 60, 62 and 64 running therethrough. Each circuit includes parallel tubes extending transversely through fins 56 and running across the length of condenser 16. Accordingly, circuit 58 includes parallel tubes 66, 68, 70 and 72; circuit 60 includes tubes 74, 76, 78 and 80; circuit 62 includes parallel tubes 82, 84, 86, and 88; and circuit 64 includes tubes 90, 92, 94, and 96. The tubes of each circuit are joined by curved tubular connecting members or return bends, broadly designated as 98, to form the circuit. Circuits 58 and 60 both traverse the top half of condenser 16, and preferably are intertwined. Circuits 62 and 64 both traverse the lower half of condenser 16, and preferably are also intertwined. The circuits 58, 60, 62 and 64 have been depicted in a very simplified form for the sake of clarity of this description. Condenser 16 is shown as having four rows of vertically aligned tubes, for example tubes 78, 70, 94 and 86 comprising one such row. Furthermore, only one horizontal tube from each circuit is shown in each row. As will be obvious to one skilled in the art, it is not necessary to the present invention that the heat exchange tubes of condenser 16 be arranged in this manner. For example, the tubes need not be vertically aligned, and each row may include a plurality of tubes from each circuit without departing from the scope of the present invention. Moreover, the extent of intertwining may be more or less than is depicted.

The circuits of condenser 16 are divided into two groups, with each group supplied with refrigerant from a different one of distributors 26 and 34. Specifically, circuits 58 and 62 comprise a first group connected to distributor 26, and circuits 60 and 64 comprise a second group connected to distributor 34. Each group includes one of the two circuits 58 and 60 traversing the upper half of condenser 16, and one of the two circuits 62 and 64 traversing the lower half of the condenser. In this manner, the refrigerant circuit groups cover in overlapping fashion the area of condenser 16 transverse to the direction of the flow of the air moving thereover. When refrigeration system 10 is operated under low load conditions, one of the compressors 12 or 14, for example compressor 12, is shut down. Refrigerant flow through circuits 58 and 62 is prevented, but refrigerant continues to flow through circuits 60 and 64. Alternately, referring to FIG. 2 where system 110 includes only one compressor 112 and system capacity is reduced by reducing compressor capacity, then refrigerant flow through distributor 26 and the group of circuits 58 and 62 is prevented by closing valve 122 located in refrigerant line 24. In both systems 10 and 110, circuits 60 and 64, the active circuits at low load, combine to cover both the top and bottom half of condenser 16. Substantially the entire surface area of each heat transfer fin 56 is in proximity to an active circuit. Further, active circuits are presented to the flow of air across the full condenser area transverse to the direction of flow. Hence, the effective heat exchange area of condenser 16 has not been appreciably reduced despite the fact that circuits 58 and 62 have been removed from service. This allows a more effective and efficient cooling of the refrigerant passing through condenser 16 at partial load conditions than is obtainable with prior art multi-circuit condensers wherein removal of a group of circuits from operation significantly reduces the effective heat exchange area of the condenser. This lowers the temperature of the refrigerant throughout systems 10 and 110, increasing the refrigeration effect produced thereby. Thus, the same refrigeration effect can be obtained with less work by systems 10 and 110, specifically the compressors thereof. This reduces the operating cost of and extends the useful life of the compressors and the refrigeration systems.

As mentioned above, preferably circuits 58 and 60 are intertwined, and circuits 62 and 64 are also intertwined. Intertwining circuits help to equalize the load distribution on the circuits in case the air flow through the area covered by the intertwined circuits is not uniform. For example, the air flow through, and hence the work load on, the top half of condenser 16 may be greater nearer the lower part of that half. By intertwining circuits 58 and 60 so that both include tubes in the lower part of the top half, the circuits share the heavier work load thereat. Likewise, by intertwining circuits 58 and 60 so that both include tubes in the upper part of the top half of condenser 16, the circuits share the relatively lighter load thereat. This provides for an evenly distributed work load between active intertwined circuits. With the work load distributed evenly between active circuits, the effect of removing one or more groups of circuits from service is shared proportionately between the circuits remaining active and is readily predictable.

While it is apparent that the invention herein disclosed is well calculated to fulfill the objects above stated, it will be appreciated that numerous modifications and embodiments may be devised by those skilled in the art, and it is intended that the appended claims cover all such modifications and embodiment as fall within the true spirit and scope of the present invention.

What is claimed is:

1. A vapor compression refrigeration system comprising:

evaporator means for evaporating refrigerant;

compressor means for compressing vaporous refrigerant;

low pressure refrigerant line means for passing refrigerant from the evaporator means to the compressor means;

a condenser including a plurality of generally parallel heat exchange fins and a plurality of refrigerant circuits running through the condenser generally transverse to the heat exchange fins, wherein groups of the refrigerant circuits cover in overlapping fashion the area of the condenser transverse to the direction of the flow of an external heat exchange medium moving thereover;

condenser-evaporator refrigerant line means for conveying condensed refrigerant from the condenser to the evaporator means;

expansion means located in the condenser-evaporator line means for reducing the temperature and pressure of refrigerant passing therethrough;

a plurality of high pressure refrigerant lines for passing refrigerant from the compressor means to the condenser;

refrigerant distribution means in each of the high pressure refrigerant lines, wherein each group of refrigerant circuits is connected to a different distribution means; and means for selectively preventing the flow of refrigerant through at least a selected one of the high pressure refrigerant lines, wherein the group of circuits connected to the distribution means in the selected refrigerant line is removable from service without appreciably reducing the effective heat exchange area of the condenser.

2. A vapor compression refrigeration system as defined by claim 1 wherein a plurality of the refrigerant circuits are intertwined.

3. A vapor compression refrigeration system as defined by claim 2 wherein the external heat exchange medium enters the condenser at a selected side thereof, and the refrigerant circuits are arranged to discharge refrigerant from the condenser at the selected side.

4. A vapor compression refrigeration system as defined by claim 3 wherein:

the compressor means includes a plurality of vapor compressors; and the preventing means includes means to shut down at least one compressor.

5. A vapor compression refrigeration system as defined by claim 3 wherein:

the compressor means includes a vapor compressor; and the preventing means includes valve means located in a high pressure refrigerant line for selectively closing the high pressure refrigerant line to refrigerant flow.

* * * * *